US009431228B2

(12) United States Patent
Loboda

(10) Patent No.: US 9,431,228 B2
(45) Date of Patent: Aug. 30, 2016

(54) ION LENS FOR REDUCING CONTAMINANT EFFECTS IN AN ION GUIDE OF A MASS SPECTROMETER

(75) Inventor: Alexandre Loboda, Thornhill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 13/696,661

(22) PCT Filed: May 10, 2011

(86) PCT No.: PCT/CA2011/000543

§ 371 (c)(1),
(2), (4) Date: Feb. 19, 2013

(87) PCT Pub. No.: WO2011/140636

PCT Pub. Date: Nov. 17, 2011

(65) Prior Publication Data

US 2013/0140454 A1 Jun. 6, 2013

Related U.S. Application Data

(60) Provisional application No. 61/333,333, filed on May 11, 2010.

(51) Int. Cl.
*H01J 49/06* (2006.01)
*H01J 49/26* (2006.01)

(52) U.S. Cl.
CPC ..... *H01J 49/067* (2013.01); *H01J 49/26* (2013.01)

(58) Field of Classification Search
CPC ..... H01J 49/067; H01J 49/26
USPC ..... 250/288
See application file for complete search history.

(56) References Cited

U.S. PATENT DOCUMENTS

| | | | | |
|---|---|---|---|---|
| 3,906,300 | A * | 9/1975 | Tran | 315/5.42 |
| 4,404,495 | A * | 9/1983 | Muller | 315/5.41 |
| 4,800,273 | A * | 1/1989 | Phillips | 250/288 |
| 4,879,518 | A * | 11/1989 | Broadhurst | 315/506 |
| 4,906,896 | A * | 3/1990 | Swenson | 315/5.41 |
| 5,164,593 | A * | 11/1992 | Chapman et al. | 250/288 |
| 5,440,203 | A * | 8/1995 | Nakanishi | 315/5.41 |
| 5,451,847 | A * | 9/1995 | Nakanishi | 315/505 |
| 5,614,711 | A * | 3/1997 | Li et al. | 250/287 |
| 5,744,919 | A * | 4/1998 | Mishin et al. | 315/505 |
| 6,032,513 | A * | 3/2000 | Chorush et al. | 73/23.35 |

(Continued)

OTHER PUBLICATIONS

International Search Report from International Patent Application No. PCT/CA2011/000543, dated Aug. 22, 2011.

(Continued)

*Primary Examiner* — Robert Kim
*Assistant Examiner* — Sean Luck

(57) ABSTRACT

An ion lens for reducing contaminant effects in an ion guide of a mass spectrometer is provided. The ion lens comprises a structural member comprising an orifice of a given radius, the structural member for supporting the ion lens at an exit region of the ion guide. The ion lens further comprises a conical member extending from the structural member, the conical member being hollow and comprising a given cone angle, and a base of the given radius, a perimeter of the base connected to a perimeter of the orifice. The conical member further comprises an aperture through an apex of the conical member, the aperture for receiving ions there through from the ion guide.

20 Claims, 11 Drawing Sheets

(56) References Cited

U.S. PATENT DOCUMENTS

| | | | | |
|---|---|---|---|---|
| 7,034,292 | B1 * | 4/2006 | Whitehouse et al. | 250/289 |
| 7,960,690 | B2 | 6/2011 | Schwartz et al. | |
| 2001/0020679 | A1 * | 9/2001 | Franzen | 250/293 |
| 2002/0036262 | A1 * | 3/2002 | Bowdler et al. | 250/287 |
| 2002/0038850 | A1 | 4/2002 | Satta et al. | |
| 2002/0175278 | A1 | 11/2002 | Whitehouse | |
| 2003/0222210 | A1 * | 12/2003 | Stott et al. | 250/282 |
| 2006/0226354 | A1 | 10/2006 | Schneider et al. | |
| 2009/0014645 | A1 * | 1/2009 | Chernushevich et al. | 250/292 |
| 2009/0236518 | A1 | 9/2009 | Kobayashi | |
| 2009/0302785 | A1 * | 12/2009 | Miller et al. | 315/505 |

OTHER PUBLICATIONS

International Preliminary Report on Patentability from International Patent Application No. PCT/CA2011/000543, dated Nov. 13, 2012.

* cited by examiner

ION LENS FOR REDUCING CONTAMINANT EFFECTS IN AN ION GUIDE OF A MASS SPECTROMETER

CROSS REFERENCE TO RELATED APPLICATIONS

The application is a National Stage filing under 35 U.S.C. §371 of PCT/CA/000543 filed on May 10, 2011, which designated the U.S., and which claims the benefit of U.S. Provisional Application Ser. No. 61/333,333 filed on May 11, 2010, the contents of which are incorporated herein by reference in their entireties.

FIELD

The specification relates generally to mass spectrometers, and specifically to an ion lens for reducing contaminant effects in an ion guide of a mass spectrometer.

BACKGROUND

In mass spectrometers, ion guides typically have an ion lens at an exit end comprising a plate having an aperture for ions from the ion guide to pass through. The ion lens can act as an element in a differential pumping system. However, such ion lenses are prone to contamination and hence are generally deficient.

BRIEF DESCRIPTIONS OF THE DRAWINGS

Implementations are described with reference to the following figures, in which.

DETAILED DESCRIPTION

Figure 1:
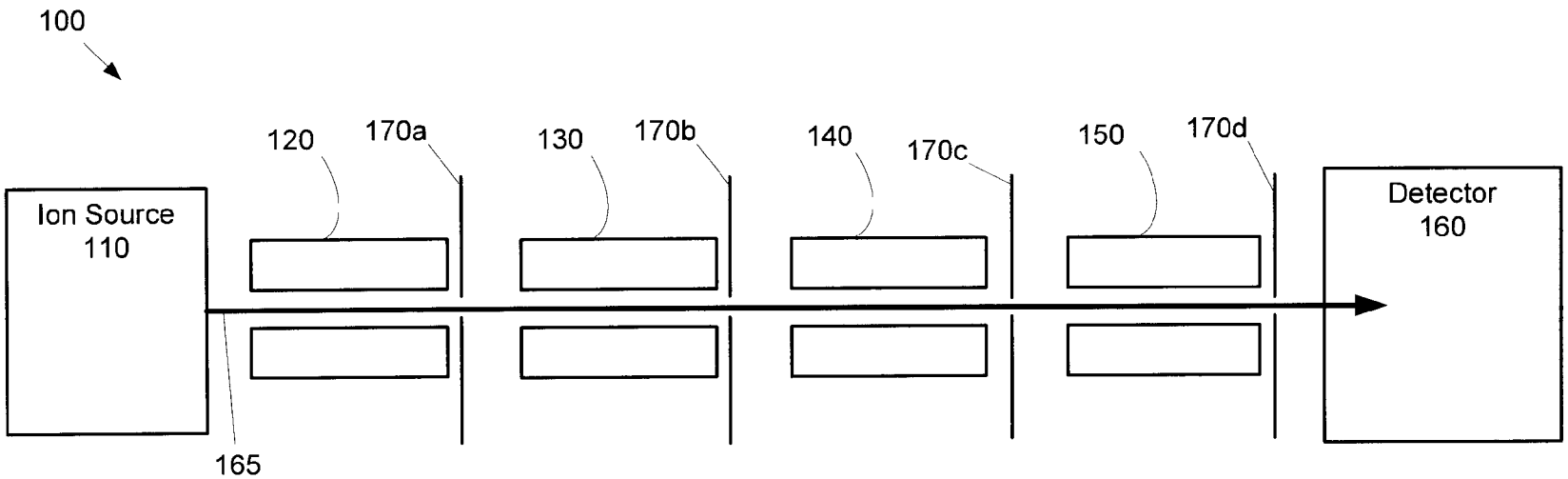
PRIOR ART Fig. 1
FIG. 1 depicts a block diagram of a mass spectrometer with flat ion lenses, according to the prior art.

A first aspect of the specification provides an ion lens for reducing contaminant effects in an ion guide of a mass spectrometer. The ion lens comprises a structural member comprising an orifice of a given radius, the structural member for supporting the ion lens at an exit region of the ion guide. The ion lens further comprises a conical member extending from the structural member, the conical member being hollow and comprising a given cone angle, and a base of the given radius, a perimeter of the base connected to a perimeter of the orifice, the conical member further comprising an aperture through an apex of the conical member, the aperture for receiving ions there through from the ion guide.

The given radius, and the given cone angle can enable at least a portion of the conical member, including the apex, to reside within the exit region of the ion guide The orifice can be located in a centre portion of the structural member and the conical member can extend from the centre portion.

The cone angle can be at least one of: between 10° and 80°; between 40° and 50°; and 45°.

The conical member can comprise at least one of: a cone; a convex cone; and a concave cone.

The conical member can be complimentary to an exit region of the ion guide, and the exit region of the ion guide can comprise a shape that is an inverse of the conical member. The exit region of the ion guide can be bevelled.

The structural member can be at least one of: complimentary to an end face of the ion guide; planar; a cylindrical section; and a spherical section.

A second aspect of the specification provides a mass spectrometer. The mass spectrometer comprises an ion source. The mass spectrometer further comprises a plurality of ion guides for receiving ions from the ion source, each of the plurality of ion guides comprising an entrance region, an exit region and a passage there between for ions from the ion source to pass there through. The mass spectrometer further comprises at least one ion lens located at an end face of at least one of the plurality of ion guides. The at least one ion lens comprises a structural member comprising an orifice of a given radius, the structural member for supporting the ion lens at an exit region of the at least one of the plurality of ion guides. The at least one ion lens comprises a conical member extending from the structural member, the conical member being hollow and comprising a given cone angle, and a base of the given radius, a perimeter of the base connected to a perimeter of the orifice, the conical member further comprising an aperture through an apex of the conical member, the aperture for receiving ions there through from the at least one of the plurality of ion guides. The mass spectrometer further comprises a detector located after the plurality of ion guides and the at least one ion lens for detecting the ions.

The given radius, and the given cone angle can enable at least a portion of the conical member, including the apex, to reside within the exit region of the at least one of the plurality of ion guides.

The orifice can be located in a centre portion of the at least one of the plurality of ion guides and the conical member can extend from the centre portion.

The cone angle can be at least one of: between 10° and 80°; between 40° and 50°; and 45°.

The conical member can comprise at least one of: a cone; a convex cone; and a concave cone.

The conical member can be complimentary to the exit region of the at least one of the plurality of ion guides. The exit region can comprise a shape that is an inverse of the conical member. The exit region of the at least one of the plurality of ion guides can be bevelled.

The structural member can be at least one of: complimentary to an end face of the at least one of the plurality of ion guides; planar; a cylindrical section; and a spherical section.

The aperture of the at least one ion lens can be aligned with the exit region of the at least one of the plurality of ion guides. The structural member can be substantially parallel to the end face of the at least one of the plurality of ion guides.

The conical member and the exit region can form at least one channel for gas exiting the at least one of the plurality of ion guides to pass there through. The mass spectrometer can further comprise a sleeve surrounding the at least one of the plurality of ion guides for containing the gas until the gas reaches the at least one channel.

When the conical member becomes contaminated with the ions, an angle of a resulting electrical field and a longitudinal axis of the at least one of the plurality of ion guides can be greater than zero.

Contamination of optical elements of mass spectrometer, for example an ion guide, due to contaminant ions and particles (such as clusters and/or droplets) is problematic as it reduces the transmission efficiency of the ion guide which impacts sensitivity of the mass spectrometer and introduces irreproducibility due to charging of contaminated surfaces. This is a common problem for virtually all ion optical elements in a mass spectrometer. In the case of ion guides that employ collisional cooling, the area most sensitive to contamination is generally the area near the exit of the ion guide. In collisional focusing, ions are slowed down and focussed by collisions with buffer gas molecules in the ion guide. Thus, when the ions reach the exit end of the ion guide their velocities are nearly thermal. In some ion guides, the pressure is high enough that gas dynamics plays a significant role. A typical ion guide setup is depicted in FIG. 1, according to the prior art, which depicts a mass spectrometer 100 comprising a first ion guide 120, a second ion guide 130, a quadrupole 140, a collision cell 150 (e.g. a fragmentation module) and a detector 160 (comprising any suitable detector, including but not limited to a ToF (Time of Flight) detector). Note that the quadrupole 140 and collision cell 150 can also be configured as ion guides. Mass spectrometer 100 is enabled to transmit an ion beam 165 from ion source 110 through to detector 160. It is appreciated that each of first ion guide 120, second ion guide 130, quadrupole 140 and collision cell 150 act as an ion guide for ions to pass there through. Ion lenses 170*a*, 170*b*, 170*c*, 170*d* (collectively ion lenses 170 and generically an ion lens 170) are located at the exits of one or more of first ion guide 110, second ion guide 130, quadrupole 140 and collision cell 150. It is appreciated that the pressure in some ion guides, for example the first ion guide 120, can be high enough so that gas dynamics can play a significant role which can exacerbate contamination issues.

In the prior art, each ion lenses 170 comprises a flat plate with an orifice for ion beam 165 to pass through as depicted in FIG. 1. The flat plate and the corresponding orifice often acts as an element of a differential pumping system allowing ion beam 165 to pass into the next chamber with a different pressure while the flow of gas into the next chamber is restricted. In some cases the pressure in an adjacent chamber can be lower, while in other cases the pressure can be higher depending on the application. Collision cell 150 is an example of a chamber where ions from the previous ion guide (i.e. quadrupole 140) enter the next chamber (collision cell 150) which contains higher pressure of gas. Various interfaces for Atmospheric Pressure Ionization (API) sources represent cases where a following chamber is at lower pressure than a previous one. In any case, when ions exiting an ion guide approach the aperture of an ion lens 170, they generally have relatively low kinetic energy, for example on the order of a Volt per unit charge. Any contaminated surface near the aperture that develops an electric potential on the order of one Volt or higher can significantly alter trajectories of ions and lead to the loss of transmission or undesired blocking of the ion beam 165. Therefore, the region near the exit of an ion guide (such as first ion guide 120, second ion guide 130, quadrupole 140 and collision cell 150), and the area near the aperture of each ion lens 170, become the most sensitive areas for contamination. The situation can be further complicated as some ion sources generate droplets and clusters in addition to the ions of interest. Such droplets and clusters can be accelerated by gas dynamic flow, for example in the area of ion source 110, and fly straight into the area near the exit region of an ion guide. Thus, the area near the ion guide can be bombarded and eventually coated by the droplets and clusters containing analyte material. This effect produces thin films that can be non-conductive and charge up leading to the problem with transmission and ion blocking, as described above.

Figure 2:
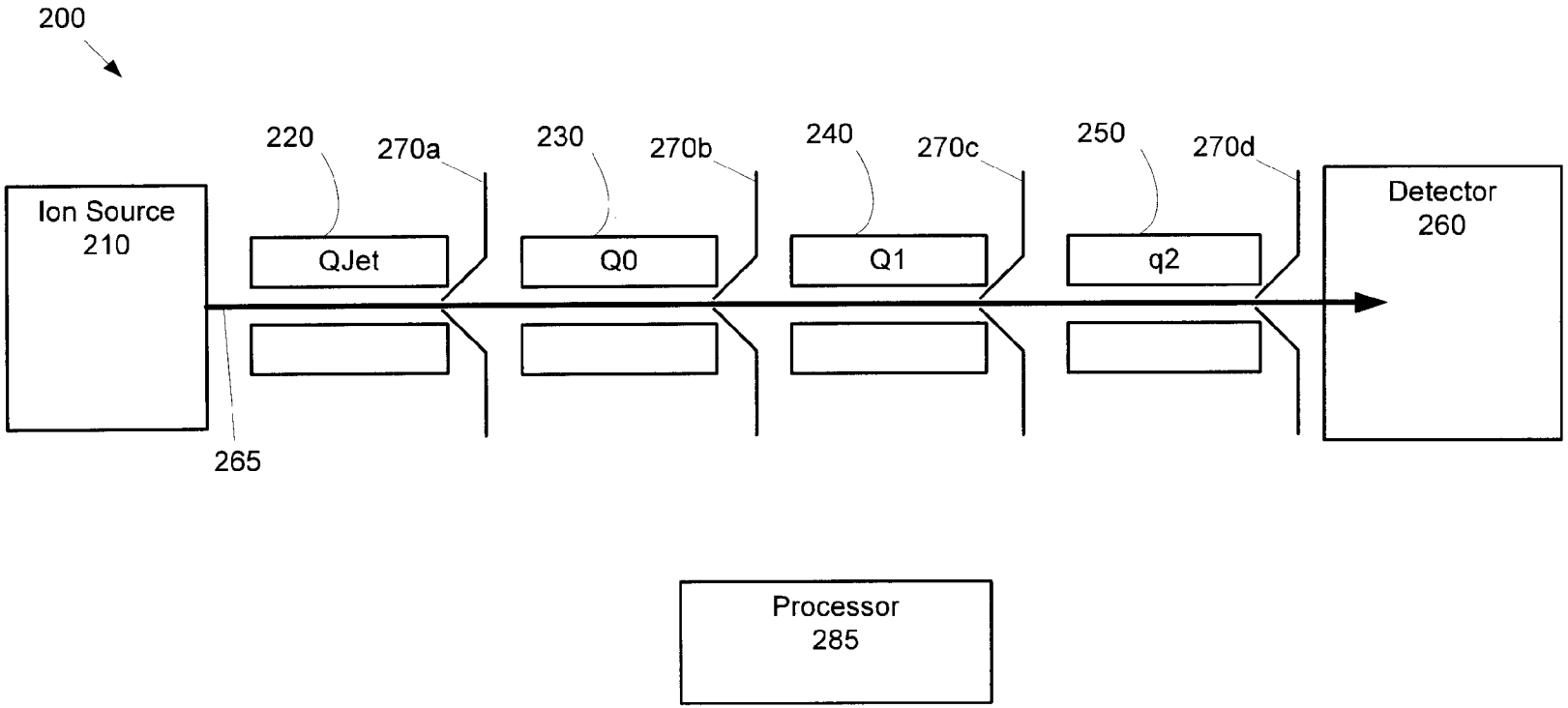
FIG. 2 depicts a block diagram of a mass spectrometer with ion lenses for reducing contaminant effects in an ion guide, according to non-limiting implementations.

These contaminant problems are addressed in a mass spectrometer 200 as depicted in FIG. 2, according to non-limiting implementations. Mass spectrometer 200 is similar to mass spectrometer 100 and comprises a first ion guide 220, a second ion guide 230, a quadrupole 240, a collision cell 250 (e.g. a fragmentation module) and a detector 260 (comprising any suitable detector, including but not limited to a ToF (Time of Flight) detector; it is appreciated that detector 260 is not to be considered particularly limiting). Mass spectrometer 200 is enabled to transmit an ion beam 265 from ion source 210 through to detector 260. It is appreciated that each of first ion guide 220, second ion guide 230, quadrupole 240 and collision cell 250 act as an ion guide for ions to pass there through. In contrast to mass spectrometer 100, mass spectrometer 200 comprises ion lenses 270*a*, 270*b*, 270*c*, 270*d* (collectively ion lens 270 and generically an ion lens 270) each of which comprise a structural member and a conical member, the conical member located at the exit of a respective ion guide (e.g. first ion guide 220, second ion guide 230, quadrupole 240 or collision cell 250). Ion lenses 270, and alternatives thereof, will be described in detail below with respect to FIGS. 3 to 11

In some implementations, mass spectrometer 200 can further comprise a processor 285 for controlling operation of mass spectrometer 200, including but not limited to controlling ion source 210 to ionise the ionisable materials, and controlling transfer of ions between modules of mass spectrometer 200. In operation, ionisable materials are introduced into ion source 210. Ion source 210 generally ionises the ionisable materials to produce ion beam 265, which is transferred to first ion guide 220 (also identified as QJet). Ion beam 265 is transferred to second ion guide 230 (also identified as Q0) through ion lens 270*a*. Ion beam 265 is transferred from second ion guide 230, though ion lens 270*b*, to quadrupole 240 (also identified as Q1), which can operate as a mass filter. Ion beam 265, filtered or unfiltered, exit quadrupole 240, via ion lens 270*c*, and enter collision cell 250 (also identified as q2). In some implementations, ions in ion beam 265 can be fragmented in collision cell 250. It is understood that collision cell 250 as well as first ion guide 220 and second ion guide 230 can comprise any suitable multipole, including but not limited to a quadrupole, a hexapole, an octopole, or any other suitable ion guide such as a ring guide, an ion funnel or the like. In some implementations, collision cell 250 comprises a quadrupole, mechanically similar to quadrupole 240. Ion beam 265 is then transferred to detector 260, via ion lens 270*d*, for production of mass spectra.

Furthermore, while also not depicted, mass spectrometer 200 can further comprise any suitable number of connectors, power sources, RF (radio-frequency) power sources, DC (direct current) power sources, gas sources (e.g. for ion source 210 and/or collision cell 250), and any other suitable components for enabling operation of mass spectrometer 200. While not depicted, mass spectrometer 200 can comprise any suitable number of vacuum pumps to provide a suitable vacuum in ion source 210, first ion guide 220, second ion guide 230, quadrupole 240, collision cell 250 and/or detector 260. It is understood that in some implementations a vacuum differential can be created between certain elements of mass spectrometer 200: for example a vacuum differential is generally applied between ion source 210, first ion guide 220, and second ion guide 230, such that ion source 210 is at atmospheric pressure, second ion guide 230 is under vacuum (e.g. approximately 10 mTorr or any other suitable pressure), and first ion guide 220 has a pressure there between (e.g. approximately 1 Torr or any other suitable pressure). Each ion lens 270 can assist in creating a vacuum differential between elements of mass spectrometer 200.

Furthermore, each ion lens 270 assists in reducing contamination effects in each of their respective ions guides (e.g. first ion guide 220, second ion guide 230, quadrupole 240 and collision cell 250), as described below. Furthermore, in the following description it is appreciated that the term ion guide can refer to one or more of ion guide 220, second ion guide 230, quadrupole 240 and collision cell 250, unless otherwise noted.

Figure 3:
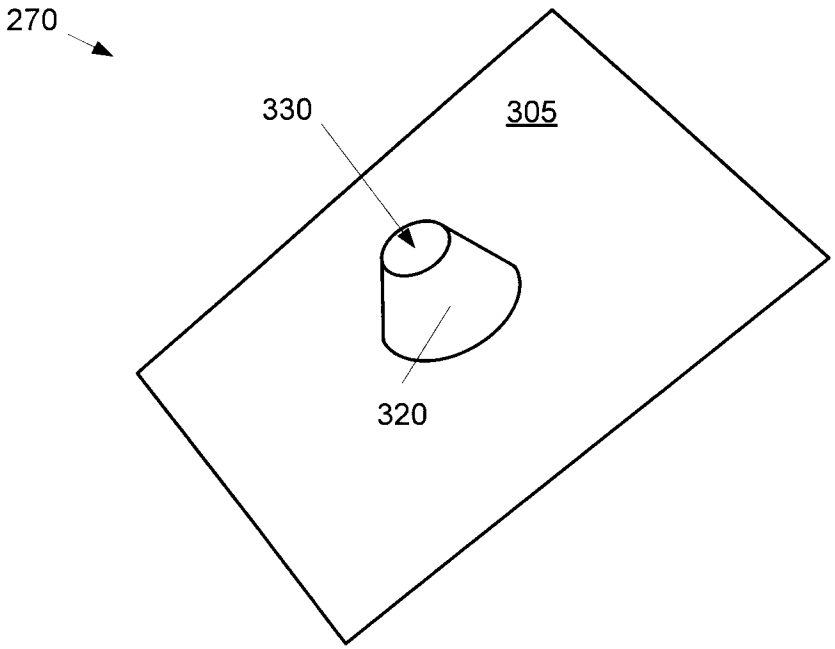
FIG. 3 depicts a perspective view of an ion guide side of an ion lens for reducing contaminant effects in an ion guide, according to non-limiting implementations.
Figure 4:
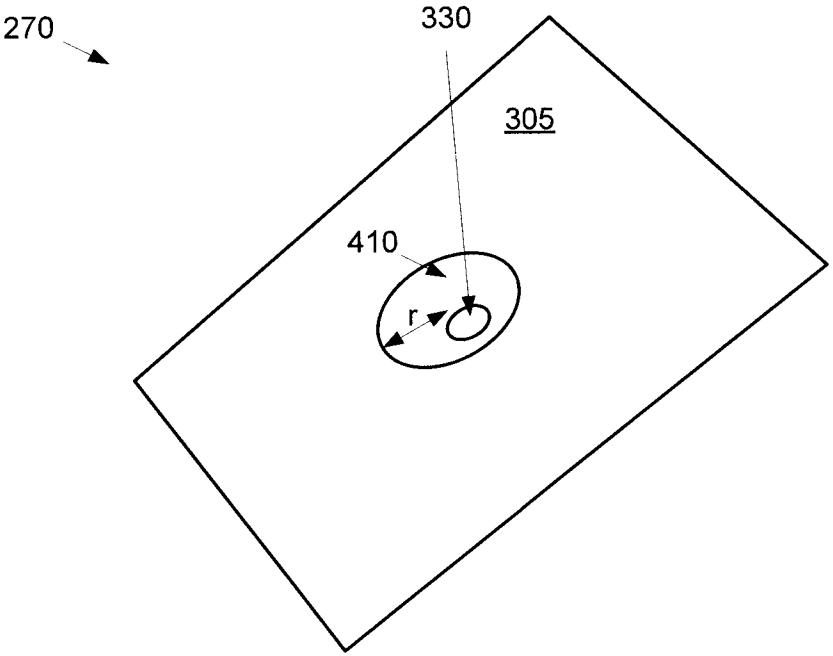
FIG. 4 depicts a perspective view of an ion exit side of the ion lens of FIG. 4, according to non-limiting implementations.
Figure 5:
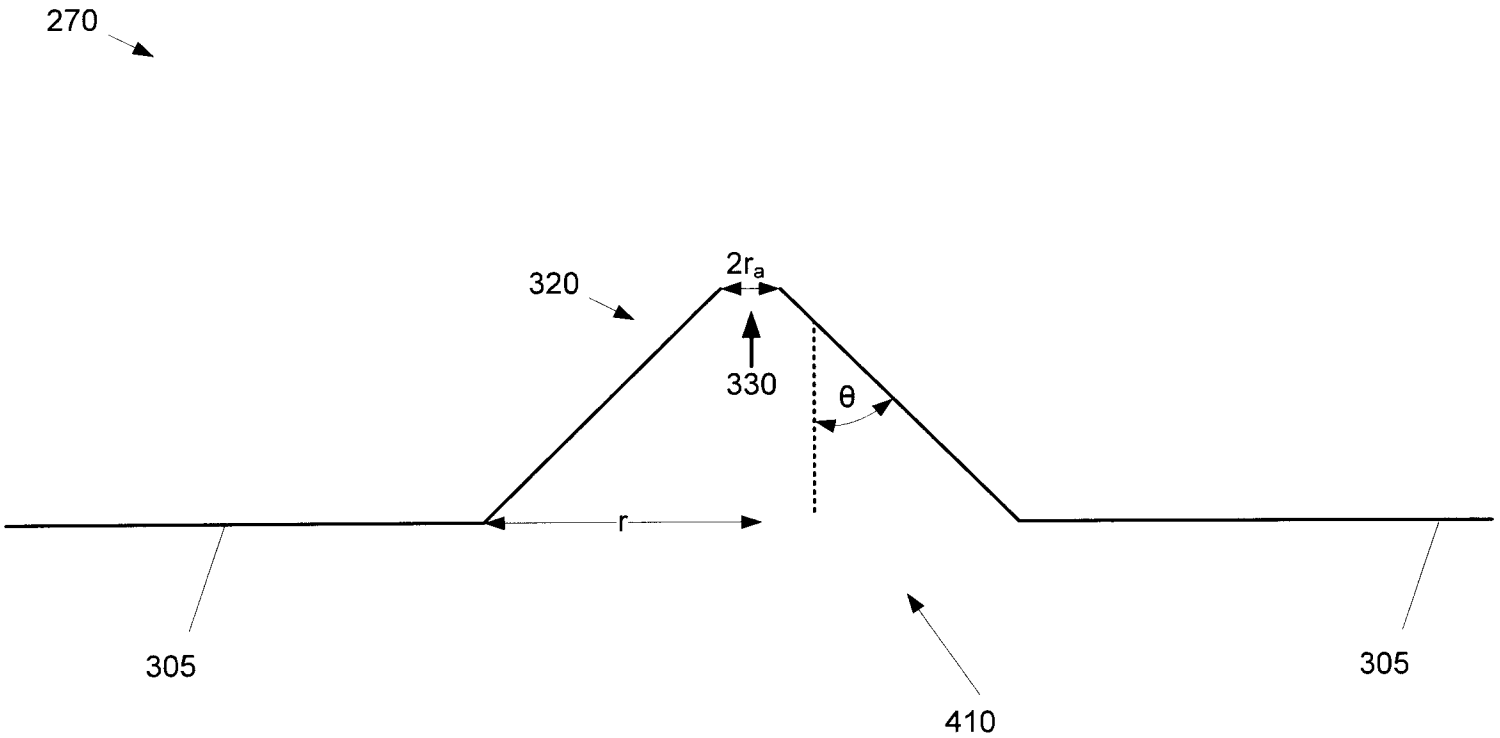
FIG. 5 depicts a cross-section of the ion lens of FIG. 4, according to non-limiting implementations.

Attention is directed to FIGS. 3, 4 and 5, which respectively depict a perspective front view of ion lens 270, a perspective rear view of ion lens 270, and a cross-sectional view of ion lens 270, according to non-limiting implementations. Ion lens 270 comprises a structural member 305. In some implementations, structural member 305 can be complimentary to an end face of an ion guide. In some of these implementations, the end face of each ion guide is generally flat, as depicted in FIG. 2, and hence structural member 305 is generally planar, as depicted. However structural member 305 can comprise a section a cylindrical section, a spherical section, or any other suitable shape. As can be seen in the rear perspective view of ion guide 270 in FIG. 4, and in FIG. 5, structural member comprises an orifice 410 of a given radius r. It is appreciated that orifice 410 can be substantially circular, but is not limited to circular openings. Indeed, orifice 410 can be of any suitable shape, including but not limited to an ellipse.

Ion lens 270 further comprises a conical member 320 extending from structural member 305. It is appreciated that conical member 320 is hollow. It is further appreciated that conical member 320 can be defined by a cone angle θ (as depicted in FIG. 5), and the radius of the base of the conical member 320 is of the same given radius r as orifice 410 of structural member 305. The perimeter of the base of conical member 320 is connected to a perimeter of orifice 410 such that conical member 320 and structural member 305 form an integrated structure. Conical member 320 further comprises an aperture 330 through an apex of conical member 320 of a radius $r_a$, aperture 330 for receiving ions there through from an ion guide.

It is further appreciated that ion lens 270 is of a size that is commensurate with an end face of an ion guide in mass spectrometer 200. For example, attention is directed to FIG. 6, which depicts a cross-section of ion lens 270 in place at an exit region 635 of an ion guide 640, (which can be similar to first ion guide 220, second ion guide 230, quadrupole 240 and/or collision cell 250), exit region 635 having a radius R. Exit region 635 is appreciated to be an end region of ion guide 640 where ions passing there through exit ion guide 640. Furthermore, it is appreciated that radius R can also be referred to as the inscribed radius of ion guide 640.

For example, a length, width and breadth of structural member 305 can be of any suitable size that enables structural member 305 to be installed at exit region 635 of ion guide 640 (and in mass spectrometer 200). A distance between elements of ion guide 640 and elements of ion lens 270 can be chosen so as to avoid electrical breakdown at operating voltages. However, the distance between elements of ion guide 640 and elements of ion lens 270 can also be chosen to avoid ion losses. In a successful non-limiting prototype, the distance between ion guide 640 and ion lens 270 can be on the order of a few millimeters.

Furthermore, it is appreciated that a size of conical member 320 is commensurate with exit region 635. In non-limiting implementations, the given radius r can be similar to the radius R of exit region 635 of ion guide 640, though given radius r can be smaller than R or greater than R. Furthermore, radius r and cone angle θ can enable at least a portion of conical member 320, including the apex, to reside within exit region 635. Cone angle θ can be approximately 45°. However, in some implementations, cone angle θ can be between approximately 40° and approximately 50°. In yet further implementations, cone angle θ can be between approximately 10° and approximately 80°. It is appreciated that when cone angle θ is smaller, conical member 270 can penetrate deeper into exit region 635.

It is further appreciated that radius $r_a$ of aperture 330 is of a size for accepting an ion beam exiting ion guide 640. Radius $r_a$ of aperture 330 can be chosen to provide efficient transmission of ion beam 265. In some implementations, the ratio of radius $r_a$ to radius R, $r_a/R$, is approximately 20%, however it is appreciated that a ratio of $r_a/R$ of approximately 0.2 is not to be considered unduly limiting and that any suitable ratio of $r_a/R$ is within the scope of present implementations. In general, however, it is appreciated that when ratio $r_a/R$ is too small, losses of ion beam 265 can occur; and when ratio $r_a/R$ is too large, too much gas will be transferred to the next stage of differential pumping through aperture 330. In a successful non-limiting successful prototype, aperture 330 has a radius $r_a$ of approximately 0.75 mm (or 1.5 mm in diameter $2r_a$).

It is further appreciated that an end face 645 of ion guide 640 is substantially parallel to structural member 305. In addition, exit region 635 and conical member 320 form at least one channel 650 for gas exiting ion guide 640 to pass there through. It is further appreciated that ion guide 640 can be encased in a suitable sleeve (not depicted) that prevents gas from escaping prior to encountering at least one channel 650; in these implementations the sleeve can be enabled to direct gas glow towards end region 635.

It is appreciated that in implementations depicted in FIGS. 2 to 6 that conical member 320 has straight sides extending from aperture 330 to structural member 305. However, FIG. 7 depicts alternative non-limiting implementations of an ion lens 270*a*, depicted in cross section. Ion lens 270*a* is similar to ion lens 270, ion lens 270*a* comprising a structural member 305*a*, and a conical member 320*a* extending from structural member 305*a*, with an aperture 330*a* there through at an apex. Each of structural member

305*a*, conical member 320*a* and aperture 330*a* are similar to structural member 305, conical member 320, and aperture 330, respectively, however conical member 320*a* has concave walls extending from an aperture 330*a* to structural member 305*a*. Hence, in these implementations, conical member 320*a* comprises a concave cone. The curvature of the walls of the concave cone can be any suitable curvature.

Figure 8:
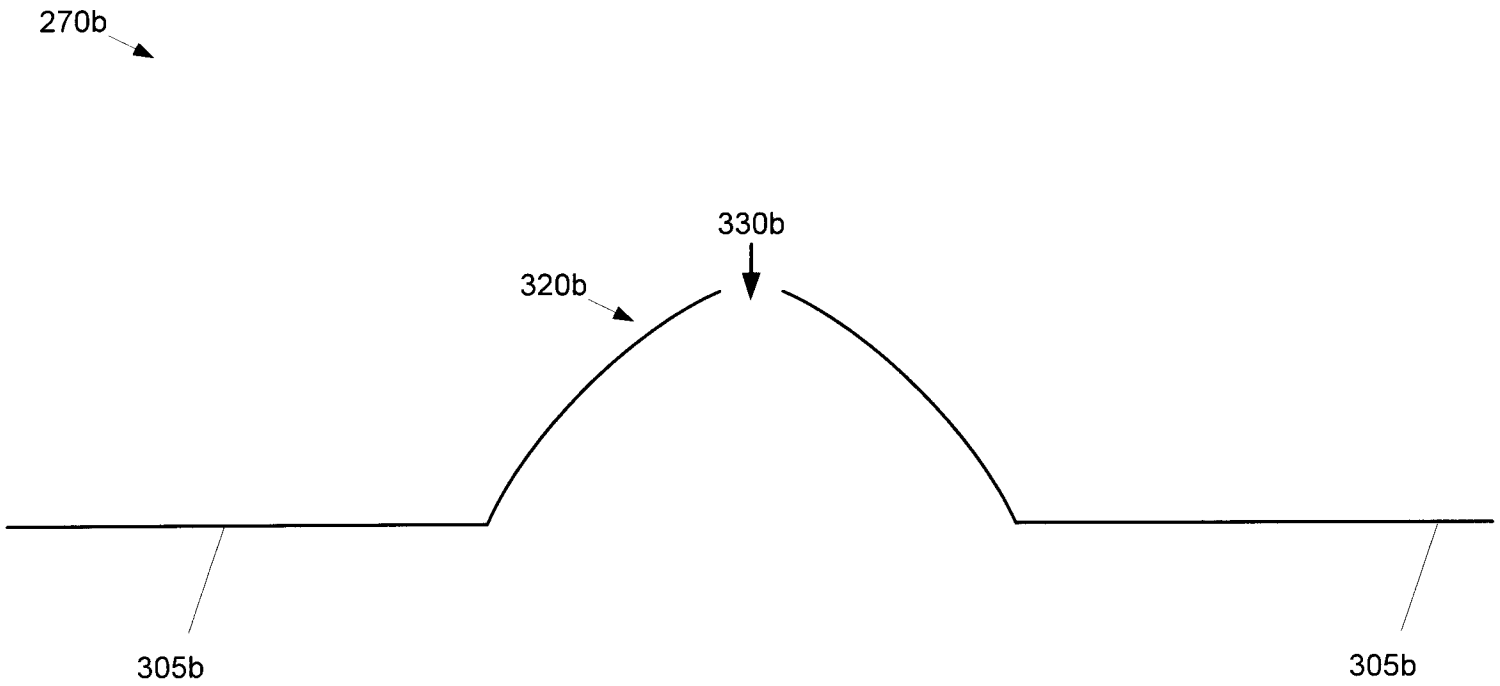

Similarly, FIG. 8 depicts alternative non-limiting implementations of an ion lens 270*b*, depicted in cross section. Ion lens 270*b* is similar to ion lens 270, ion lens 270*b* comprising a structural member 305*b*, and a conical member 320*b* extending from structural member 305*b*, with an aperture 330*b* there through at an apex. Each of structural member 305*b*, conical member 320*b* and aperture 330*b* are similar to structural member 305, conical member 320, and aperture 330*b*, respectively, however conical member 320*b* has convex walls extending from an aperture 330*b* to structural member 305*b*. Hence, in these implementations, conical member 320*b* comprises a convex cone. The curvature of the walls of the convex cone can be any suitable curvature.

Figure 9:
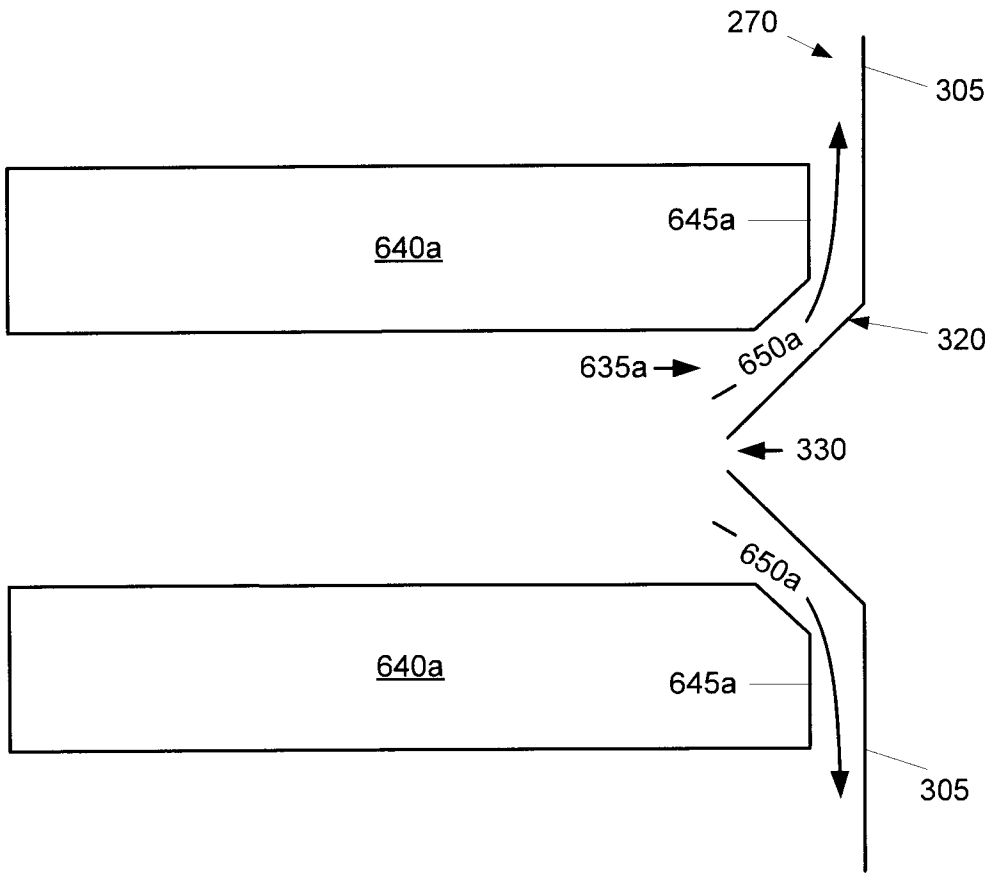
FIG. 9 depicts a block diagram of the ion guide of FIG. 4 in place at an exit region of an ion guide having a bevelled exit region, according to non-limiting implementations.

Attention is now directed to FIG. 9, which depicts ion lens 270 installed at an exit region 635*a* of an ion guide 640*a*, according to non-limiting implementations. FIG. 9 is similar to FIG. 6, however ion guide 640 has been replaced with ion guide 640*a*. Ion guide 640*a* is similar to ion guide 640, however exit region 635*a* of ion guide 640 has a cross section similar to conical member 320, so that conical member 320 can fit therein. In other words, exit region 635*a* comprises a shape that is approximately an inverse conical member 320. Hence, in some implementations, the walls of conical member 320 and the walls of exit region 635*a* are substantially parallel to one another; further it is appreciated that an end face 645*a* of ion guide 640*a* is substantially parallel to structural member 305. It is yet further appreciated that exit region 635*a* of ion guide 640*a* is bevelled.

Hence, exit region 635*a* and conical member 320 form at least one channel 650*a* for gas exiting ion guide 640*a* to pass there through.

Figure 10:
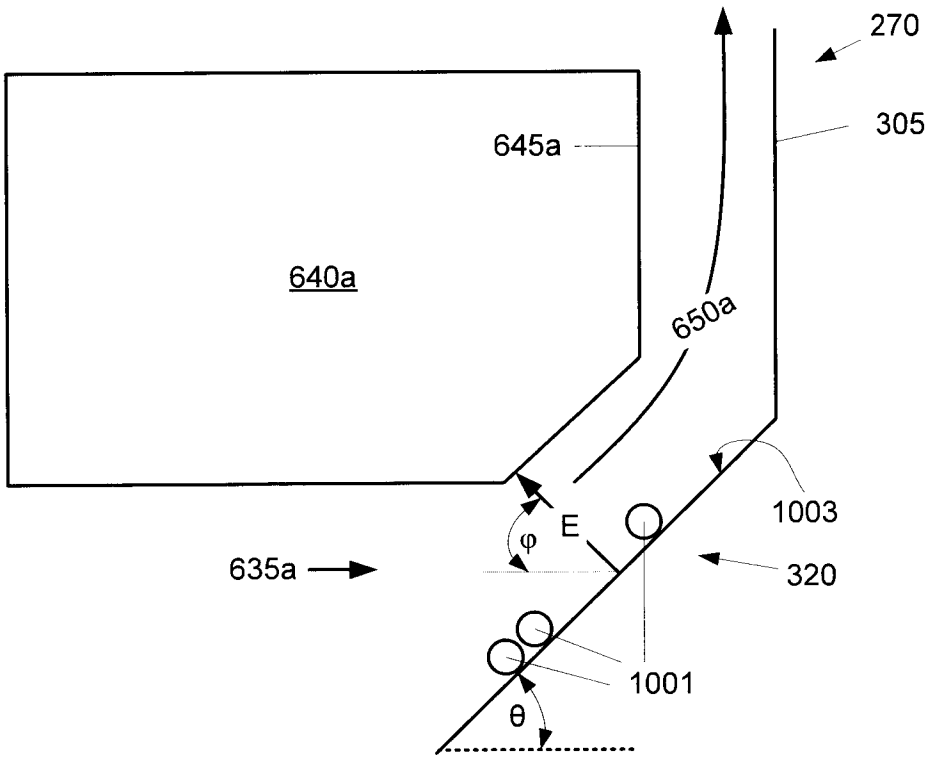
FIG. 10 depicts detail of elements FIG. 9, according to non-limiting implementations; and, FIG. 11 depicts a graph showing results of testing a successful prototype of the ion lens of FIG. 4, according to non-limiting implementations.

Attention is now directed to FIG. 10, which depicts a portion of FIG. 9, including an upper portion of channel 650*a*, a portion of ion guide 640*a* and a portion of ion lens 270, in more detail, with like elements having like numbers. However, FIG. 10 also schematically depicts contaminant 1001 on an ion guide facing side 1003 of conical member 320. Contaminant 1001 can, in some implementations, be carried into channel 650*a* via a buffer gas exiting ion guide 640*a* via channel 650*a*. Furthermore, when contaminant 1001 is charged, a resulting electric filed E forms an angle $\phi$ with a longitudinal axis of ion guide 640*a*, angle $\phi$ being greater than 0°. Indeed, it is appreciated that in these implementations, in the area of channel 650*a* where the walls of conical member 320 are parallel to walls of exit region 635*a*, that angle $\phi$ is similar to cone angle $\theta$.

Figure 6:
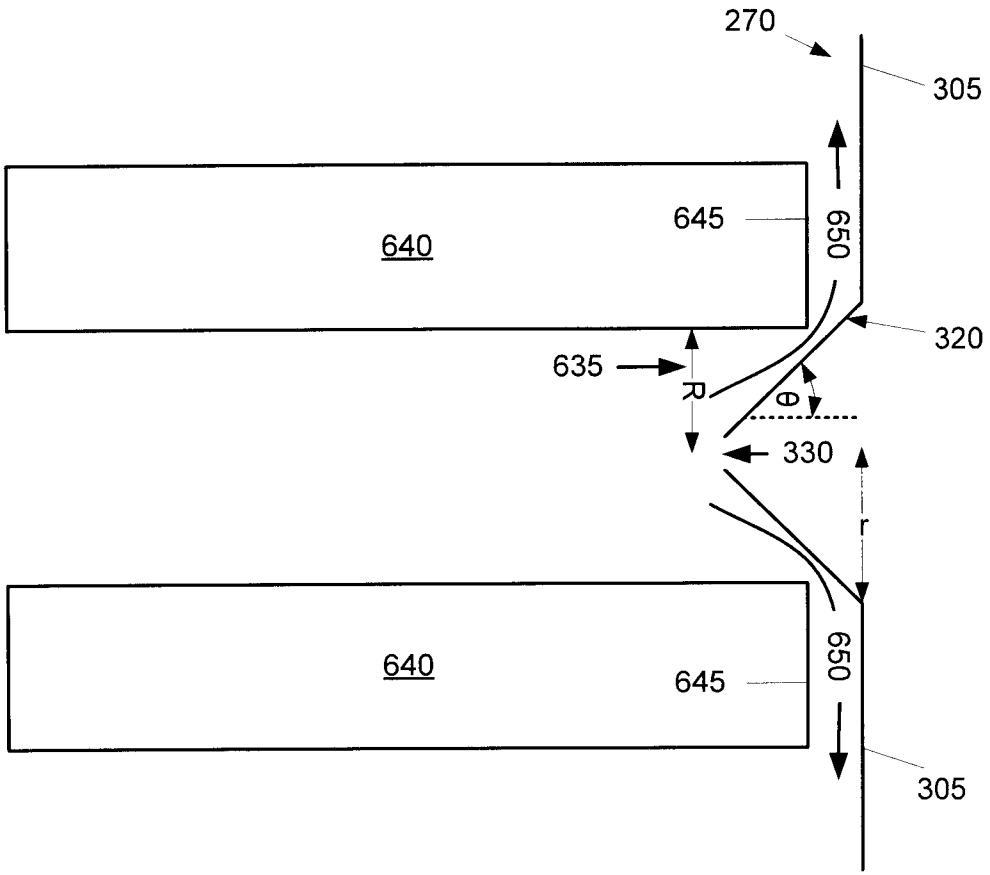
FIG. 6 depicts a block diagram of the ion lens of FIG. 4 in place at an exit region of an ion guide, according to non-limiting implementations.
Figure 7:
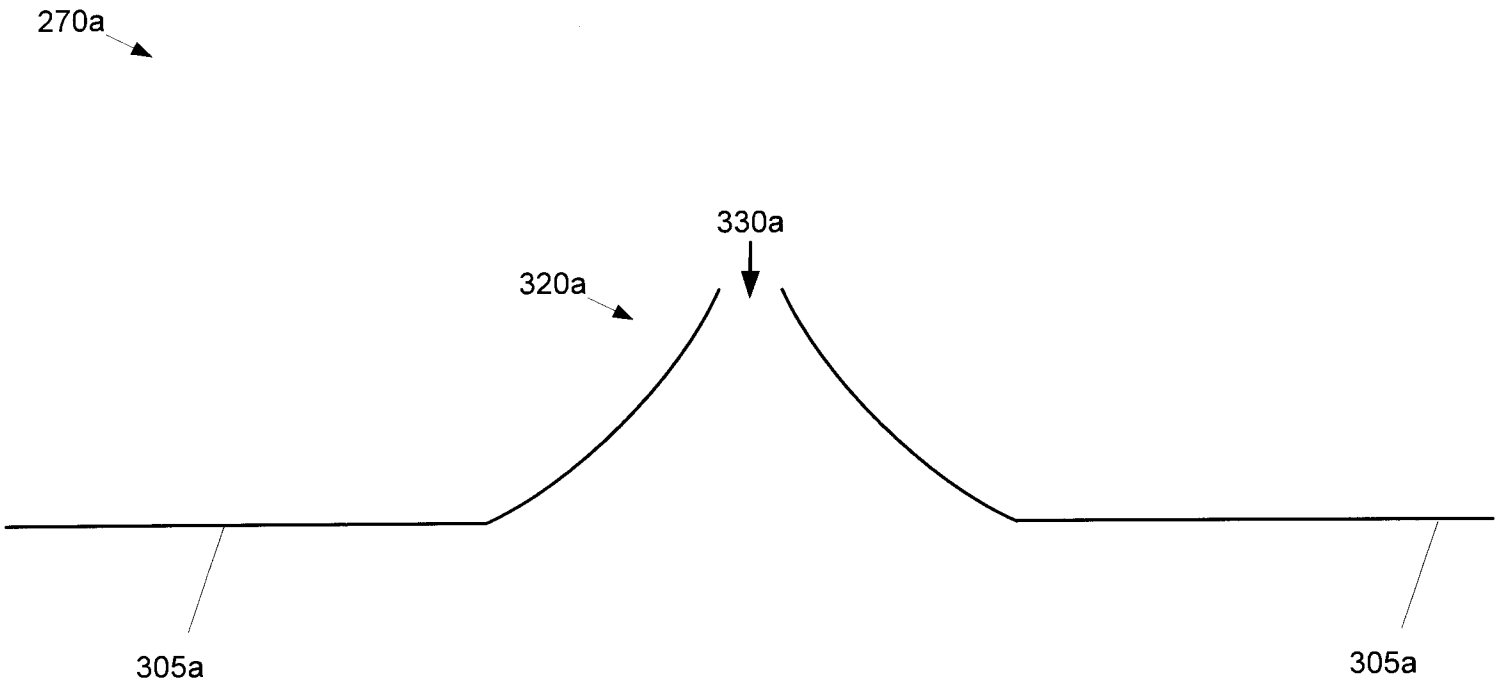
FIGS. 7 and 8 depict cross-section of ion lens for reducing contaminant effects in an ion guide, according to non-limiting implementations.

It is further appreciated that a similar electric field can form in the arrangement depicted in FIG. 6, with such an electric field pointing between conical member 320 and walls of exit region 635.

In any event, in either arrangement (i.e. the arrangement of FIG. 6 or the arrangement of FIGS. 9 and 10), the electric field that forms due to contaminants will have less effect on an ion beam passing through the respective ion guide, than an electric field that forms due to contaminant on ion lens 170 of FIG. 1. Indeed, it is appreciated that in FIG. 1, as ion lens 170 comprises a flat plate, an electric field that forms due to contaminant will be parallel to a longitudinal axis of a respective ion guide. Hence, electric fields that form due to contaminant on conical member 320 will have less effect on an ion beam as the electric field is directed away from the respective longitudinal axis.

Figure 11:
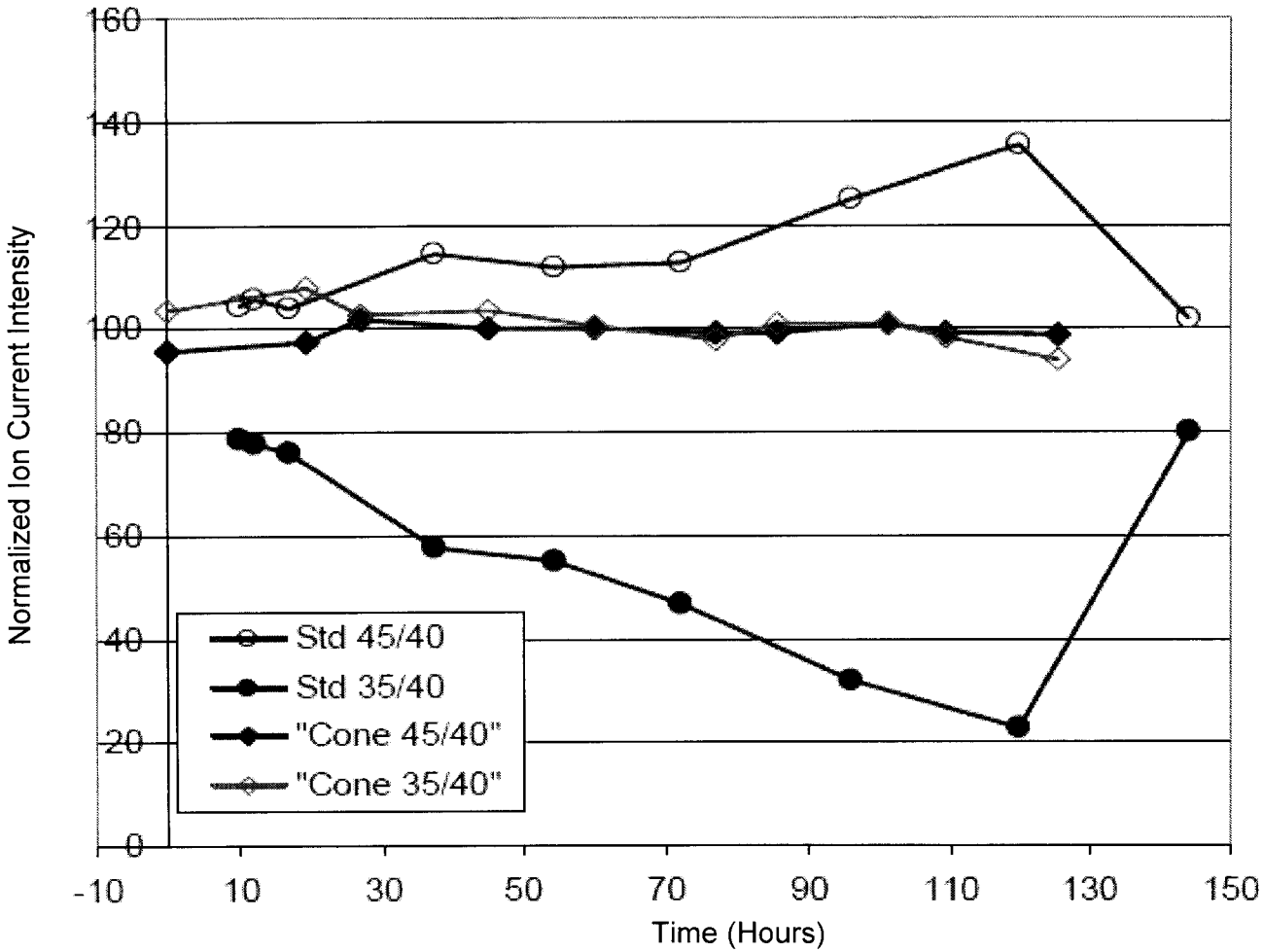

Attention is now directed to FIG. 11, which depicts results of testing a successful prototype of ion lens 270, with a cone angle $\theta$ of 45° as compared to flat ion lens 170. FIG. 11 depicts variation of normalized ion current intensity, over time, of an ion beam passing through respective similar ion guides with ion lens 270 and ion lens 170 in place after the ion guides as described above, with voltages of 45V and 35V applied as a DC (direct current) offset to the ion guides and voltage of 40 V applied to the respective ion lens. The ion intensities are normalized to the intensities recorded when the ion guide offset and the lens voltage are set to be the same (40 V/40 V for each of the ion guide and the respective ion lens) for each configuration. Hence the ion current density over time was measured under four different test conditions, in addition to the 40V/40V normalization:

1. Ion lens 170 at 40 V with an ion guide offset of 45 volts (a difference of +5 volts with respect to the exit region the ion guide), as represented by the open circles in FIG. 11, and labelled "Std 45/40".
2. Ion lens 170 at 40 V with an ion guide offset of 35 volts (a difference of −5 volts with respect to the exit region of the ion guide), as represented by the closed circles in FIG. 11, and labelled "Std 35/40".
3. Ion lens 270 at 40 V with an ion guide offset of 45 volts (a difference of +5 volts with respect to the exit region of the ion guide), as represented by the closed diamonds in FIG. 11, and labelled "Cone 45/40".
4. Ion lens 170 at 40 V with an ion guide offset of 35 volts (a difference of −5 volts with respect to the exit region of the ion guide), as represented by the open diamonds in FIG. 11, and labelled "Cone 35/40".

It is appreciated that a normalized ion current is provided in FIG. 11.

It is yet further appreciated that from 0 to 120 hours, the normalized ion current intensity for ion lens 170 (for either test condition of 35 V or 45 V applied to the ion guide), changes over time as contaminant builds up on ion lens 170; at 120 hours a cleaning of ion lens 170 occurred. Hence, the last point on the graph of FIG. 1 for each curve associated with ion lens 170 (i.e. labelled "Std 45/40" and "Std 35/40") represents the normalized ion current density after cleaning: performance has returned to the level observed at 5-10 hours.

It is further appreciated that the normalized ion current for ion lens 270 (for either test condition of 35 V or 45 V applied to the ion lens) is generally constant over time, indicating that contaminant effects have been reduced relative to lens 170. Furthermore, time between cleaning cycles is significantly longer for ion lens 270 than for ion lens 170.

Hence there can be at least several advantages that result from using an ion guide with an ion lens 270 comprising conical member 320, as compared to a flat ion lens 170:

Due to the conical shape of conical member 270, aperture 330 can be placed within the exit region of an ion guide before an ion beam passing there through has a chance to spread out as naturally occurs when an ion beam exits an ion guide (e.g. between an ion guide and a flat ion lens 170). Hence, ion lens 270 can be more efficient at sampling an ion beam than is ion lens 170, when conical member 320 is placed within the exit region of the ion guide. When ion guide is bevelled at the exit region, as in FIGS. 9 and 10, aperture 330 can be placed further into an ion guide than when the ion guide is not bevelled as in FIG. 6.

When the ion guide is operated at a high pressure, gas dynamics can play a role in the rate of contamination. The conical member 320 can enable smooth gas flow between conical member 320 and the end of the ion guide, which carries contaminants away with the flow (as opposes to impinging on a surface of a flat ion lens 170). Therefore, the rate at which contaminating particles will be depositing on the surface can be reduced. Further, when ion guide is bevelled, as in FIGS. 9 and 10, gas flowing through channels formed between ion lens 270 and the ion guide changes direction and velocity less abruptly and hence continues to carry contaminant rather then disturb contaminant out of the gas flow and precipitate onto either the exit region of the ion guide or onto ion lens 270, as occurs with ion lens 170.

Furthermore, deposition of droplets and clusters flying as projectiles along the longitudinal axis of the ion guide can be less efficient for the conical surface of conical member 320. For example, conical member 320 presents a larger surface area over which contaminant can be deposited, as compared to the flat surface of ion lens 170. Thus, it can take longer for a contamination coating to develop on conical member 270 as compared to ion lens 170.

Moreover, due to the conical shape, less contaminant is deposited on the conical member 320 near aperture 330, which can reduce the influence of contaminants ion motion near the exit region of the ion guide. Hence, the net electric field for the same voltage (developed due to charging) can be lower.

In addition, an electric field that develops due to contamination will be pointing away from the longitudinal axis of the ion guide (i.e. at angle $\phi$) rather than along the longitudinal axis: an electric field pointing along the longitudinal axis blocks the ion motion along the longitudinal axis while a field pointing away from the longitudinal axis can have a reduced effect on the motion of the ion beam near the longitudinal axis.

Persons skilled in the art will appreciate that there are yet more alternative implementations and modifications possible for implementing the implementations, and that the above implementations and examples are only illustrations of one or more implementations. The scope, therefore, is only to be limited by the claims appended hereto.

What is claimed is:

1. An ion lens at an exit region of an ion guide of a mass spectrometer, comprising:

a structural member comprising an orifice of a given radius, said structural member for supporting said ion lens; and, a skimmer electrode having a conical shaped member extending from said structural member, said conical shaped member being hollow and comprising a given internal and external cone angle, wherein a direction of ion beam propagation being the direction of zero degrees the internal angle is less than or equal to the external angle and the internal angle is greater than zero, and a base of said given radius, a perimeter of said base connected to a perimeter of said orifice, said conical shaped member further comprising an aperture through an apex of said conical shaped member, said aperture for receiving ions there through from said ion guide.

2. The ion lens of claim 1, wherein said given radius, and said given cone angle enable at least a portion of said conical shaped member, including said apex, to reside within said exit region of said ion guide.

3. The ion lens of claim 1, wherein said orifice is located in a centre portion of said structural member and said conical shaped member extends from said centre portion.

4. The ion lens of claim 1, wherein said cone angle is at least one of: between 10° and 80°; between 40° and 50°; and 45°.

5. The ion lens of claim 1, wherein said conical member comprises at least one of: a cone, a convex cone; and a concave cone.

6. The ion lens of claim 1, wherein said conical member is complimentary to an exit region of said ion guide, and wherein said exit region of said ion guide comprises a shape that is an inverse of said conical member.

7. The ion lens of claim 6, wherein said exit region of said ion guide is bevelled.

8. The ion lens of claim 1, wherein said structural member is at least one of: complimentary to an end face of said ion guide; planar; a cylindrical section; and a spherical section.

9. A mass spectrometer comprising:

an ion source;

a plurality of ion guides for receiving ions from said ion source, each of said plurality of ion guides comprising an entrance region, an exit region and a passage there between for ions from said ion source to pass there through;

at least one ion lens located at an end face of at least one of said plurality of ion guides, said at least one ion lens comprising:

a structural member comprising an orifice of a given radius, said structural member for supporting said ion lens at an exit region of said at least one of said plurality of ion guides; and, a skimmer electrode having a conical shaped member extending from said structural member, said conical shaped member being hollow and comprising a given internal and external cone angle, wherein a direction of ion beam propagation being the direction of zero degrees the internal angle is less than or equal to the external angle and the internal angle is greater than zero, and a base of said given radius, a perimeter of said base connected to a perimeter of said orifice, said conical shaped member further comprising an aperture through an apex of said conical shaped member, said aperture for receiving ions there through from said at least one of said plurality of ion guides; and a detector located after said plurality of ion guides and said at least one ion lens for detecting said ions.

10. The mass spectrometer of claim 9, wherein said given radius, and said given cone angle enable at least a portion of said conical shaped member, including said apex, to reside within said exit region of said at least one of said plurality of ion guides.

11. The mass spectrometer of claim 9, wherein said orifice is located in a centre portion of said at least one of said plurality of ion guides and said conical shaped member extends from said centre portion.

12. The mass spectrometer of claim 9, wherein said cone angle is at least one of:

between 10° and 80°; between 40° and 50°; and 45°.

13. The mass spectrometer of claim 9, wherein said conical shaped member comprises at least one of: a cone; a convex cone; and a concave cone.

14. The mass spectrometer of claim 9, wherein said conical shaped member is complimentary to said exit region of said at least one of said plurality of ion guides, and wherein said exit region comprises a shape that is an inverse of said conical member.

15. The mass spectrometer of claim 14, wherein said exit region of said at least one of said plurality of ion guides is bevelled.

16. The mass spectrometer of claim 9, wherein said structural member is at least one of: complimentary to an end face of said at least one of said plurality of ion guides; planar; a cylindrical section; and a spherical section.

17. The mass spectrometer of claim 9, wherein said aperture of said at least one ion lens is aligned with said exit region of said at least one of said plurality of ion guides and wherein said structural member is substantially parallel to said end face of said at least one of said plurality of ion guides.

18. The mass spectrometer of claim 9, wherein said conical shaped member and said exit region form at least one channel for gas exiting said at least one of said plurality of ion guides to pass there through.

19. The mass spectrometer of claim 18, further comprising a sleeve surrounding said at least one of said plurality of ion guides for containing said gas until said gas reaches said at least one channel.

20. The mass spectrometer of claim 9, wherein when said conical shaped member becomes contaminated with said ions, an angle of a resulting electrical field and a longitudinal axis of said at least one of said plurality of ion guides is greater than zero.

* * * * *